US010418713B2

(12) United States Patent
Seo et al.

(10) Patent No.: US 10,418,713 B2
(45) Date of Patent: Sep. 17, 2019

(54) WAVEGUIDE POWER DIVIDER, WAVEGUIDE PHASE SHIFTER, AND POLARIZED ANTENNA USING SAME

(71) Applicant: KMW INC., Hwaseong-si (KR)

(72) Inventors: Yong-Won Seo, Hwaseong-si (KR); Myung-Hwa Kim, Hwaseong-si (KR)

(73) Assignee: KMW INC., Hwaseong-si (KR)

( * ) Notice: Subject to any disclaimer, the term of this patent is extended or adjusted under 35 U.S.C. 154(b) by 0 days.

(21) Appl. No.: 15/828,454

(22) Filed: Dec. 1, 2017

(65) Prior Publication Data

US 2018/0090846 A1 Mar. 29, 2018

Related U.S. Application Data

(63) Continuation of application No. PCT/KR2016/001498, filed on Feb. 15, 2016.

(30) Foreign Application Priority Data

Jun. 3, 2015 (KR) ..... 10-2015-0078490

(51) Int. Cl.
*H01Q 13/00* (2006.01)
*H01Q 13/02* (2006.01)
(Continued)

(52) U.S. Cl.
CPC ..... *H01Q 13/02* (2013.01); *H01P 1/182* (2013.01); *H01P 5/12* (2013.01); *H01Q 15/24* (2013.01);
(Continued)

(58) Field of Classification Search
CPC .... H01Q 13/02; H01Q 13/06; H01Q 21/0043; H01Q 21/005; H01Q 3/267; H01Q 3/34
(Continued)

(56) References Cited

U.S. PATENT DOCUMENTS 6,750,736 B1 6/2004 Weller et al.
9,571,183 B2 * 2/2017 Runyon ..... H01Q 1/288

FOREIGN PATENT DOCUMENTS

CN 102176528 A 9/2011
JP 03-258001 A 11/1991
(Continued)

OTHER PUBLICATIONS

International Search Report dated May 23, 2016 for PCT/KR2016/001498 and its English translation.
(Continued)

*Primary Examiner* — Joseph J Lauture

(57) ABSTRACT

The present disclosure provides a polarized antenna including a waveguide power divider, a waveguide phase shifter and a radiating unit. The waveguide power divider is configured to have an input waveguide for receiving a transmission signal, and first and second output waveguides for distributing and outputting the transmission signal. The waveguide phase shifter is configured to receive two output signals outputted respectively from the first and second output waveguides of the waveguide power divider, to variably change a phase difference between the two input signals, and to output respective changed signals. The radiating unit is configured to receive the respective changed signals from the waveguide phase shifter, and to combine and radiate the respective changed signals as a radio signal.

9 Claims, 34 Drawing Sheets

(51) Int. Cl.

| | |
|---|---|
| ***H01Q 21/24*** | (2006.01) |
| ***H01Q 15/24*** | (2006.01) |
| ***H01P 1/18*** | (2006.01) |
| ***H01P 5/12*** | (2006.01) |
| *H01Q 21/00* | (2006.01) |
| *H01Q 13/06* | (2006.01) |
| *H01Q 3/26* | (2006.01) |
| *H01Q 3/34* | (2006.01) |

(52) U.S. Cl.
CPC ..... *H01Q 21/24* (2013.01); *H01Q 3/267* (2013.01); *H01Q 3/34* (2013.01); *H01Q 13/06* (2013.01); *H01Q 21/005* (2013.01); *H01Q 21/0043* (2013.01)

(58) Field of Classification Search
USPC ..... 343/772, 703, 771, 786, 876
See application file for complete search history.

(56) References Cited

FOREIGN PATENT DOCUMENTS

| | | | |
|---|---|---|---|
| JP | 2005-051332 | A | 2/2005 |
| KR | 10-0710708 | B1 | 4/2007 |
| KR | 10-0721871 | B1 | 5/2007 |
| KR | 10-2007-0088443 | A | 9/2008 |
| KR | 10-2010-0041248 | A | 12/2010 |
| KR | 10-1092846 | B1 | 12/2011 |
| KR | 10-2012-0118753 | A | 10/2012 |
| KR | 10-1491725 | B1 | 2/2016 |

OTHER PUBLICATIONS

First office action dated May 29, 2019 for Chinese Application No. 201680032686.X.

* cited by examiner

| state | pol | Power (V:H) | phase diff(V:H) |
|---|---|---|---|
| 1 | -45 | 50:50 | 180:0 |
| | -45~V | | 180:0 |
| 2 | V | 100:0 | 0:0 |
| | V~+45 | | 0:0 |
| 3 | +45 | 50:50 | 0:0 |
| | +45~H | | 0:0 |
| 4 | H | 0:100 | 0:0 |

*FIG. 8*

WAVEGUIDE POWER DIVIDER, WAVEGUIDE PHASE SHIFTER, AND POLARIZED ANTENNA USING SAME

CROSS-REFERENCE TO RELATED APPLICATION

This application is a Continuation of International Application No. PCT/KR2016/001498, filed on Feb. 15, 2016, which claims the benefit of and priority to Korean Patent Application No. 10-2015-0078490, filed on Jun. 3, 2015, which are herein incorporated by reference in their entirety.

TECHNICAL FIELD

The present disclosure in some embodiments relates to a radio frequency apparatus used in a radio communication system. More particularly, the present disclosure relates to a waveguide power divider, a variable waveguide phase shifter, and a polarized antenna using the same.

BACKGROUND

Examples of the super-high frequency transmission/reception antenna include a parabolic antenna, a microstrip antenna and a waveguide slot array antenna. Of these, the microstrip array antenna or waveguide slot array antenna is generally used for the purpose of miniaturization by size reduction.

A microstrip array antenna has a microstrip patch array structure using a dielectric substrate which, however, has its characteristic dielectric loss factor to cause substantial signal loss during transmission or reception, and a conductor resistance to add loss with the total loss loss becoming larger as the frequency becomes higher. The use of microstrip array antenna is, therefore, not favoured in the superhigh frequency band.

The waveguide slot array antenna has a typical waveguide structure formed with slot-like holes using no dielectric substrate or the like. Prior art examples related to such a waveguide slot array antenna include Korean patent application No. 2006-0018147 (titled "Multilayer Slot Array Antenna," applicant: Motonix, Inc., inventors: Cho, Tae Kwan et al., filing date: Feb. 24, 2006), and Korean patent application No. 2007-7000182 (titled "Planar Antenna Module, Triplate Planar Array Antenna, And Triplate Line-waveguide Converter," applicant: Hitachi Chemical Co., Ltd., inventors: Oota Masahiko, et al., filing date: Jan. 4, 2007).

A type of high-pass filter, waveguide is generally a hollow metal tube with its internal mode having a certain cutoff wavelength, and its fundamental mode being determined by the size of the waveguide. In microwave transmission line, waveguides have been preferred for the advantageous small attenuation over parallel two-wire lines, a coaxial cable or the like, and they have been mainly used for a high output. Waveguides, having various cross-sectional shapes, may be classified into circular waveguide, square waveguide, elliptical waveguide, etc. For the state of the art mobile communication system like the next-generation 5G system, emerging technologies utilize millimeter waves which measure millimeters in wavelength and assume such frequency as 28 GHz or 60 GHz. Multilateral technologies are currently studied for higher performance implementation as well as higher efficiency implementation of various waveguide type devices suitable for processing the millimeter wave signals, for example, a filter or a power distributor, and the like.

In order to realize an arbitrary linearly polarized wave or linear polarization with a typical array antenna, a basic element could be rotated in the same manner as the desired polarization. However, in a waveguide slot array antenna, it is difficult to rotate a single slot because the antenna is structurally integrated with the waveguide that energizes the antenna. This means that the typical antenna is structured not to allow for the polarization to be variably adjusted in practice. Instead, it is usual to rotate the shape of the slot array antenna, but where the shape of a specific antenna is limited, it is difficult to maintain arbitrary polarization. Prior art related to a waveguide slot array antenna having an arbitrary linear polarization has been disclosed by Korean patent application No. 2006-0046075 (titled: "Waveguide Slot Array Antenna For Receiving Random Polarized Satellite Signal," applicant: Wiworld Co., Ltd., inventor: Park Chan-goo, filing date: May 23, 2006), and Korean patent application No. 2010-0095624 (titled: "A Series Slot Array Antenna," applicant: Seoul National University R&DB Foundation et al., inventors: Kim, Dong Yeon, et al., filing date: Sep. 30, 2010).

DISCLOSURE

Technical Problem

The present disclosure in some embodiments seeks to provide a waveguide power divider having a waveguide structure for enabling variable power distribution, a waveguide phase shifter having a waveguide structure for enabling variable phase shifting of transmission signals along two waveguides, and a polarized antenna that provides signals with arbitrary linear polarization by using the waveguide power divider and the waveguide phase shifter.

SUMMARY

At least one embodiment of the present disclosure provides a polarized antenna including a waveguide power divider, a waveguide phase shifter and a radiating unit. The waveguide power divider is configured to have an input waveguide for receiving a transmission signal, and first and second output waveguides for distributing and outputting the transmission signal. The waveguide phase shifter is configured to receive two output signals outputted respectively from the first and second output waveguides of the waveguide power divider, to variably change a phase difference between the two input signals, and to output respective changed signals. The radiating unit is configured to receive the respective changed signals from the waveguide phase shifter, and to combine and radiate the respective changed signals as a radio signal.

The waveguide power divider may include a main case, a power distribution adjusting plate and an operating device. The main case is made of metal configured to form an input waveguide designed in compliance with a characteristic of a relevant frequency to process, and to form first and second output waveguides that are structured to be connected to the input waveguide, and that are, without affecting the characteristic of the relevant frequency to process, configured to merge with the input waveguide and to be defined respectively by two halves of a cavity area in the main case, the cavity area corresponding to the input waveguide. The power distribution adjusting plate is configured to be formed by at least some of the first and second output waveguides partitioned by halving the cavity area corresponding to the input waveguide in the main case, and to have a distal end portion that corresponds to a point where a signal input at the input waveguide is distributed to the first and second output waveguides and that is movable to reach upper or lower surface in an internal cavity of the main case. The operating device is configured to be connected to the distal end portion, and to reposition the distal end portion in conjunction with an external manipulation.

The operating device may include a rotation knob installed on an outer side of the main case, and an adjustment pin configured to be rotated in conjunction with the rotation knob in the internal cavity of the main case, and to be provided with a threaded structure generally externally of the adjustment pin. Here, the distal end portion of the power distribution adjustment plate may be configured to be provided with a hole or grooves sized to engage with the threaded structure of the adjustment pin and to have a predetermined room for the adjustment pin to slightly move in fore and aft direction.

The operating device may include an adjustment pin and an operating structure. The adjustment pin is configured to have a middle point fixed, in the internal cavity of the main case, to the distal end portion of the power distribution adjusting plate, and have opposite ends passing through holes formed at corresponding positions of the main case and protruding externally of the main case. The operating structure is configured to be disposed externally of the main case to upwardly and downwardly move the adjustment pin by portions protruding externally.

The waveguide phase shifter may include a first case and a second case. The first case is configured to have a first-first waveguide designed in compliance with a characteristic of a relevant frequency to process, and a second waveguide having a delaying waveguide path to provide a transmission signal with a preset phase difference with respect to the first waveguide. The second case is configured to have a third waveguide designed in compliance with the characteristic of the relevant frequency to process, and a fourth waveguide having a delaying waveguide path to provide a transmission signal with a preset phase difference with respect to the third waveguide. Here, the first case and the second case are configured and provided so that the first waveguide and second waveguide of the first case respectively have input and output ends aligned with input and output ends of the third waveguide and the fourth waveguide of the second case. The first case and the second case are configured to be in abutment while at least one of the first case and the second case is rotatable and is supported by an external support structure. The first waveguide and the second waveguide of the first case are each formed symmetrically with respect to an axis of rotation of the at least one of the first case and the second case, and the third waveguide and the fourth waveguide of the second case are each formed symmetrically with respect to the axis of rotation.

Advantageous Effects

As described above, in some embodiments of the present disclosure, the waveguide power divider having a waveguide structure is capable of variable power distribution, and the waveguide phase shifter having a waveguide structure is capable of variable phase shifting of transmission signals along two waveguides. In particular, the polarization antenna implemented by using the waveguide power divider and the waveguide phase shifter, allows the selection of polarization or alignments according to the installation environment of any given antenna, among other adaptations, and thereby provides signals with arbitrary linear polarization as the user desires.

BRIEF DESCRIPTION OF THE DRAWINGS

FIG. 8 is a table showing example states of polarization variation of the polarized antenna in FIG. 1.

DETAILED DESCRIPTION

Figure 1:
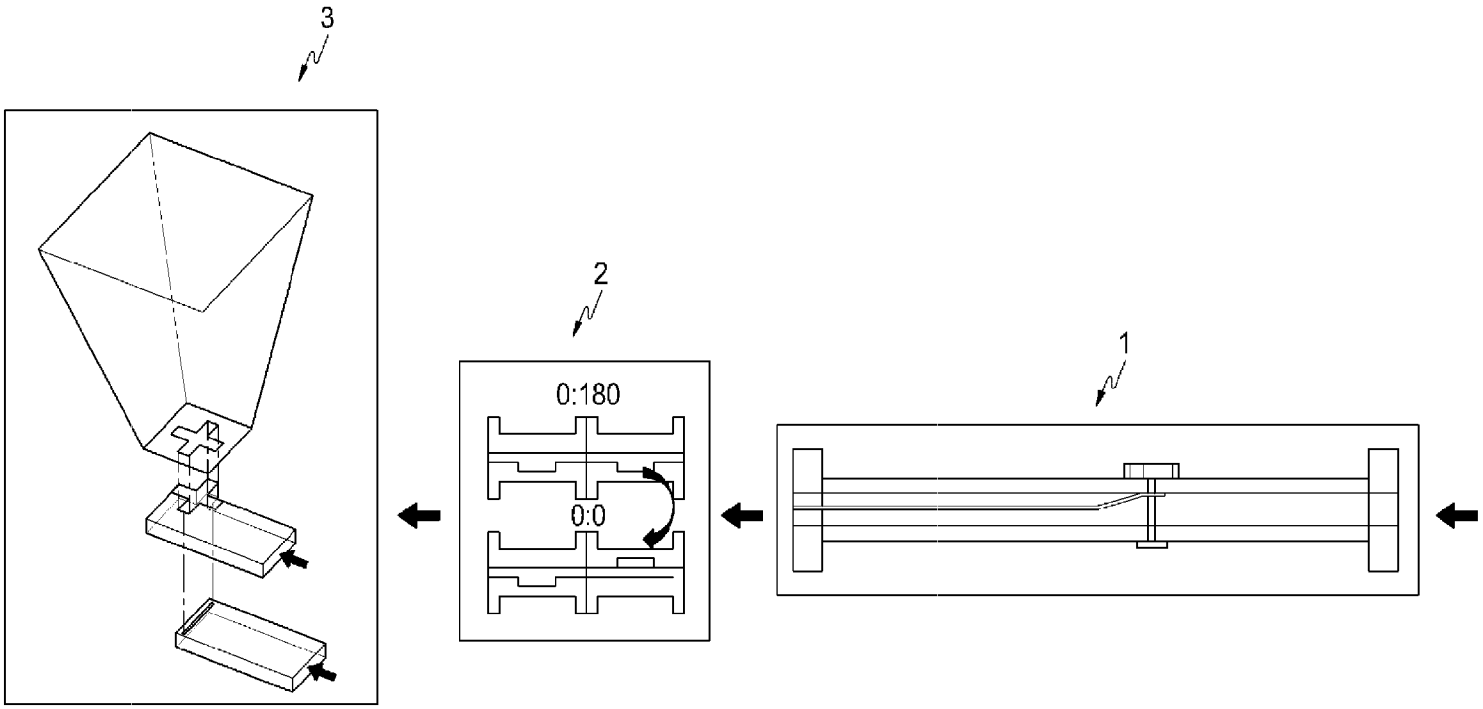
FIG. 1 is a schematic diagram of a configuration of a polarized antenna made with a waveguide power distributor or power divider and a waveguide phase shifter according to some embodiments of the present disclosure.

Hereinafter, some embodiments of the present disclosure will be described in detail with reference to the accompanying drawings. Specific items such as particular elements are illustrated in the following description soley for the purpose of serving general understanding of the present disclosure, and the present disclosure certainly contemplates various changes and modifications to be made. In the following description, like reference numerals designate like elements, although the elements are shown in different drawings. In the accompanying drawings, structures are exaggerated to emphasize some embodiments of the disclosure or reduced to facilitate the comprehension thereof.

FIG. 1 is a schematic diagram of a configuration of a polarized antenna made with a waveguide power divider and a waveguide phase shifter according to some embodiments of the present disclosure. Referring to FIG. 1, a polarized antenna according to some embodiments of the present disclosure includes a waveguide power divider 1, a waveguide phase shifter 2 and a radiating unit 3. The waveguide power divider 1 has an input waveguide for receiving a transmission signal inputted, and first and second output waveguides for variably dividing and outputting the transmission signal. The waveguide phase shifter 2 is adapted to receive output signals respectively inputted after being outputted from the first and second output waveguides of the waveguide power divider 1 and to variably change and output the phase difference between the two input signals. The radiating unit 3 is adapted to receive the respective signals outputted from the waveguide phase shifter 2, and to combine these signals to radiate radio signals.

In the above description, the radiating unit 3 may employ a typical antenna structure which combines transmission signals of two input paths through two-way waveguide structure and generates dual polarization. For example, it may have a horn antenna structure based on vertical (V) and horizontal (H) polarizations. Some embodiments of the present disclosure need no separate improvement of the structure of the radiating unit 3 for the purpose of arbitrarily varying the vertical polarization in the antenna. Instead, some embodiments utilize the radiating unit 3 having the dual polarization structure for when generating the two-path transmission signals to be provided to the radiating unit 3, and enable the waveguide power divider 1 to divide the signal by varying the ratio of signal distribution to the two paths, while enabling the waveguide phase shifter 2 to vary the phase difference of the signals thus distributed, whereby collectively establishing a structure in which signals radiated from the radiating unit 3 generate a single linear polarization with the polarization direction being variable. Hereinafter, with reference to the accompanying drawings, specific configurations and operations of the respective components will be described in more detail.

Figure 2:
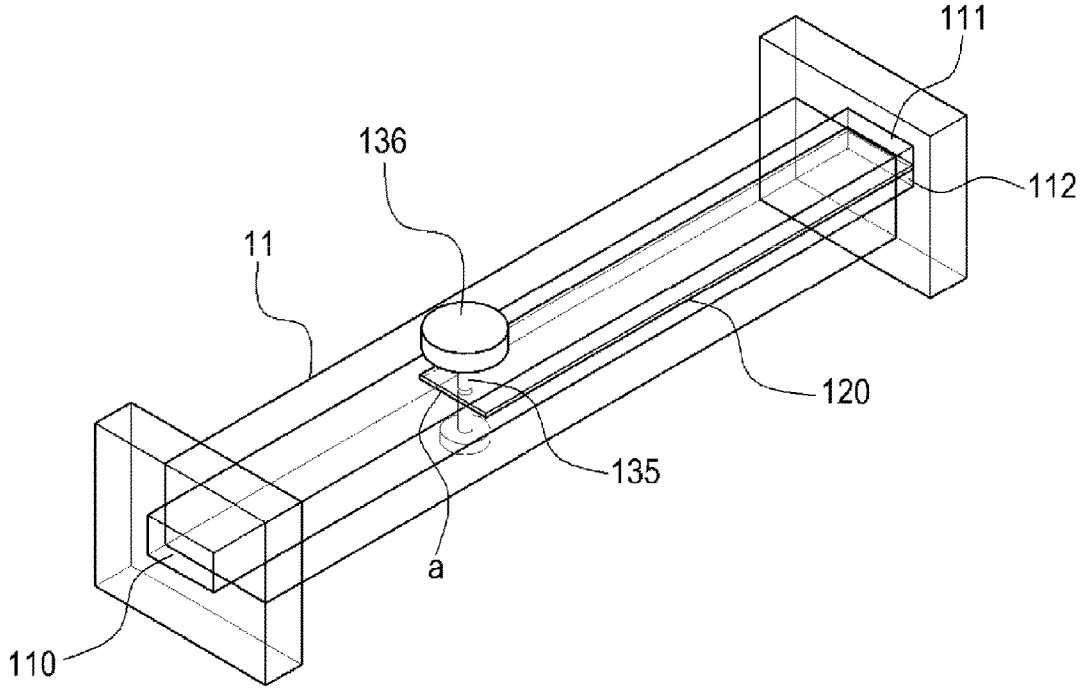
FIG. 2 is a transparent perspective view of the waveguide power divider in FIG. 1.
Figure 3A:
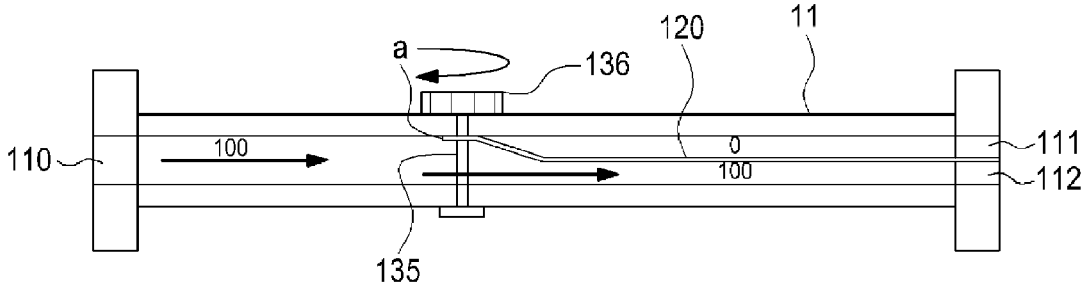
FIGS. 3A, 3B and 3C are transparent side views of the waveguide power divider in FIG. 1.
Figure 3B:
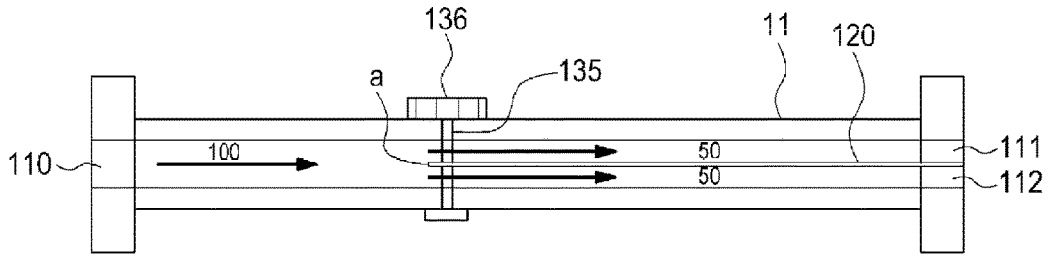
Figure 3C:
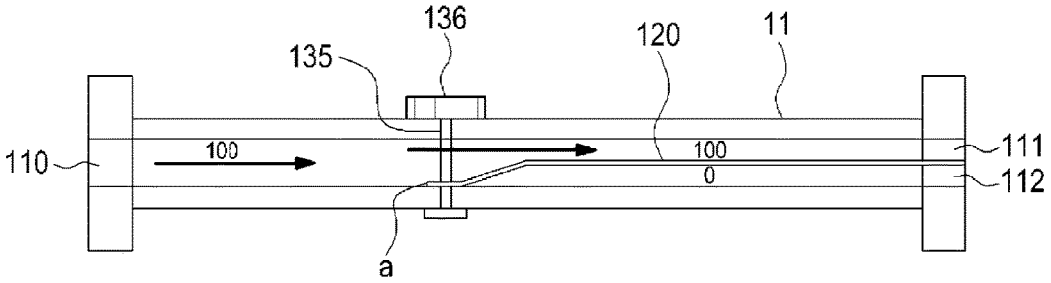

FIG. 2 is a transparent perspective view of the waveguide power divider in FIG. 1. FIGS. 3A, 3B and 3C are side views of the waveguide power divider in FIG. 1. FIG. 3A shows a state in which a signal input by an input waveguide 110 is distributed to first and second output waveguides 111, 112 at a ratio of 0:100(%), respectively, and FIG. 3B shows a state in which the signal input by the input waveguide 110 is distributed to the first and second output waveguides 111, 112 at a ratio of 50:50(%), respectively, and FIG. 3C shows a state in which the signal input by the input waveguide 110 is distributed to the first and second output waveguides 111, 112 at a ratio of 100:0(%), respectively.

Referring to FIGS. 1 to 3C, a waveguide power divider according to some embodiments of the present disclosure basically has a main case 11 made of metal for forming an input waveguide 110 designed in compliance with a characteristic of the relevant frequency to process, and first and second waveguides 111, 112 that are, without affecting the characteristic of the relevant frequency for processing, configured to merge with the input waveguide 110 and to be defined respectively by two halves of a cavity area in the main case, corresponding to that of the input waveguide 110.

Further, a power distribution adjusting plate 120 is provided in the form of a metal plate having an appropriate elasticity to form at least some of the first and second output waveguides 111, 112 partitioned by halving the cavity area corresponding to the input waveguide 110 in the main case 11. The power distribution adjusting plate 120 is installed so that most part thereof is fixed inside the cavity, but it has a portion connected to the input waveguide 110, i.e., a distal end portion 'a' corresponding to the point where the signal input at the input waveguide 110 is distributed to the first and second output waveguides 111, 112, which is not fixed but bendable so that it may move well enough to reach the upper or lower surface inside the cavity.

In addition, there are provided operating devices which are connected to the distal portion 'a' and which are capable of repositioning the distal portion 'a' in conjunction with an external manipulation. In the structure shown in FIG. 2 and others, the operating devices may include a rotation knob 136 installed on an outer side of the main case 11, and an adjustment pin 135 that may be rotated in conjunction with the rotation knob 136 in the internal cavity of the main case 11 and that is provided with generally externally threaded structure. The distal portion 'a' of the power distribution adjustment plate 120 may be provided with a hole or grooves sized to engage with the threaded structure of the adjustment pin 135 and to have a certain room for allowing a slight movement in fore and aft direction.

With such a structure, when the rotation knob 136 is rotated clockwise or counterclockwise, the adjustment pin 135 is rotated in tandem with this rotation, which raises or lowers the distal portion 'a' of the power distribution adjustment plate 120 that is in mesh with the adjustment pin 135. Such operation, as shown in FIGS. 3A to 3C, causes the signal input to the input waveguide 110 to be divided and distributed to the first and second output waveguides 111, 112 at a variable distribution ratio before the distributed signals are outputted.

Such distal portion 'a' and its repositioning devices are similar to the formation of a valve structure, and they serve to open and close the first output waveguide 111 and the second output waveguide 112 in relative proportion to each other. At this time, the adjusting pin 135 is appropriately designed to have its size among other parameters determined with such consideration as not to adversely affect the signal processing performance of the corresponding distributor. Further, in this case, for example, around the rotation knob 136, there may be prints of a suitable scale, a rotation guide sign and the like provided for user operation.

Figure 4A:
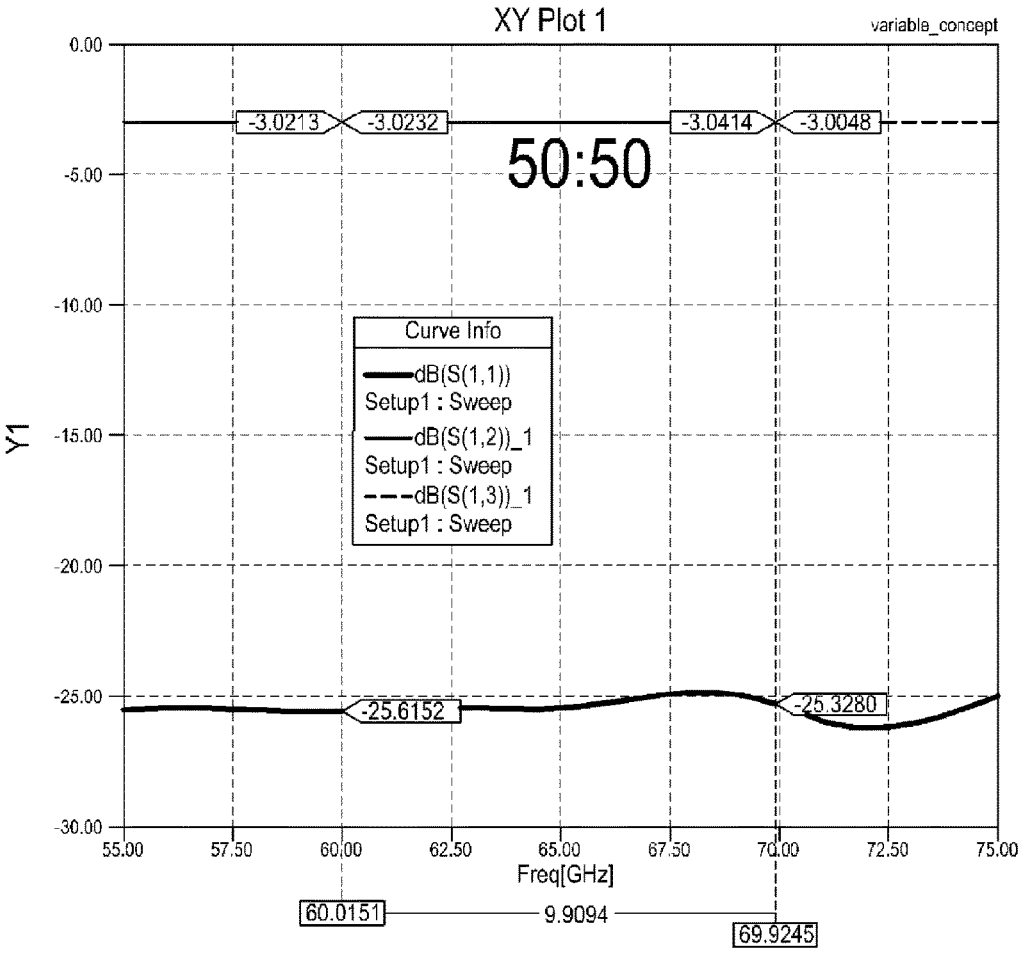
FIGS. 4A, 4B and 4C are graphs showing the electrical characteristics of the waveguide power divider in FIG. 1.
Figure 4B:
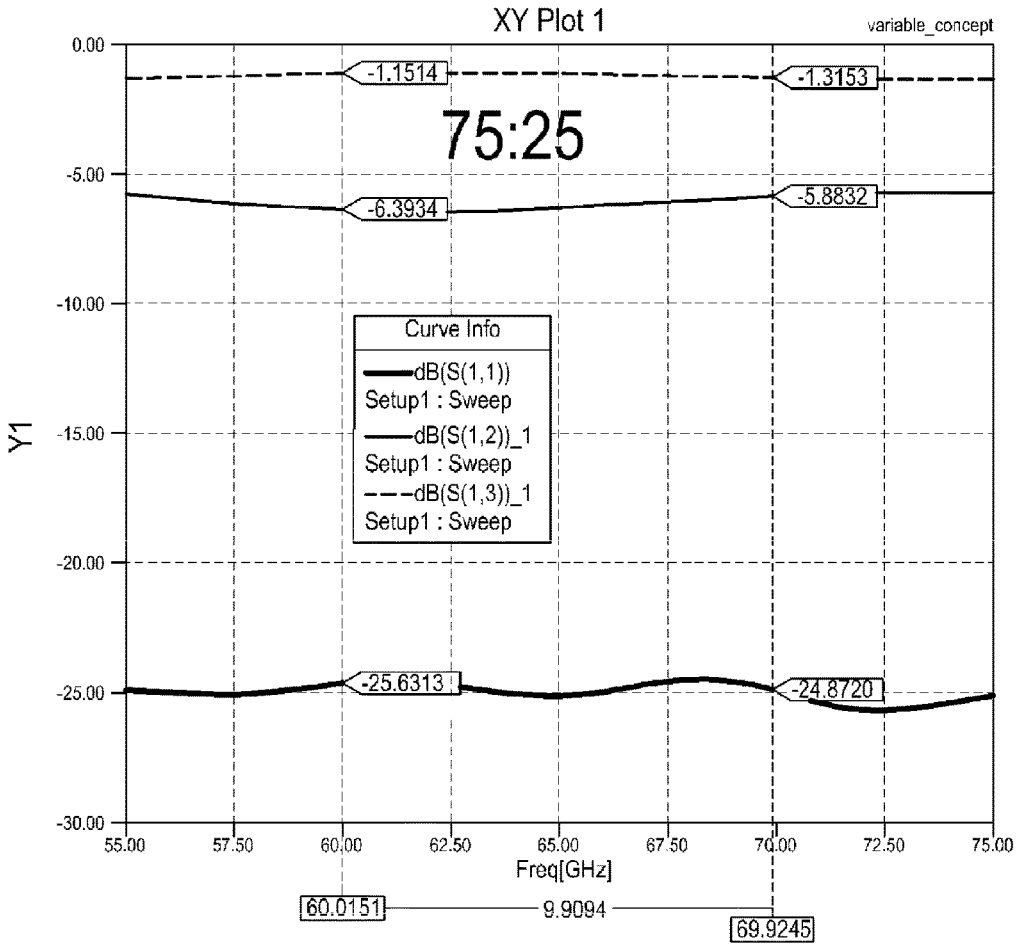
Figure 4C:
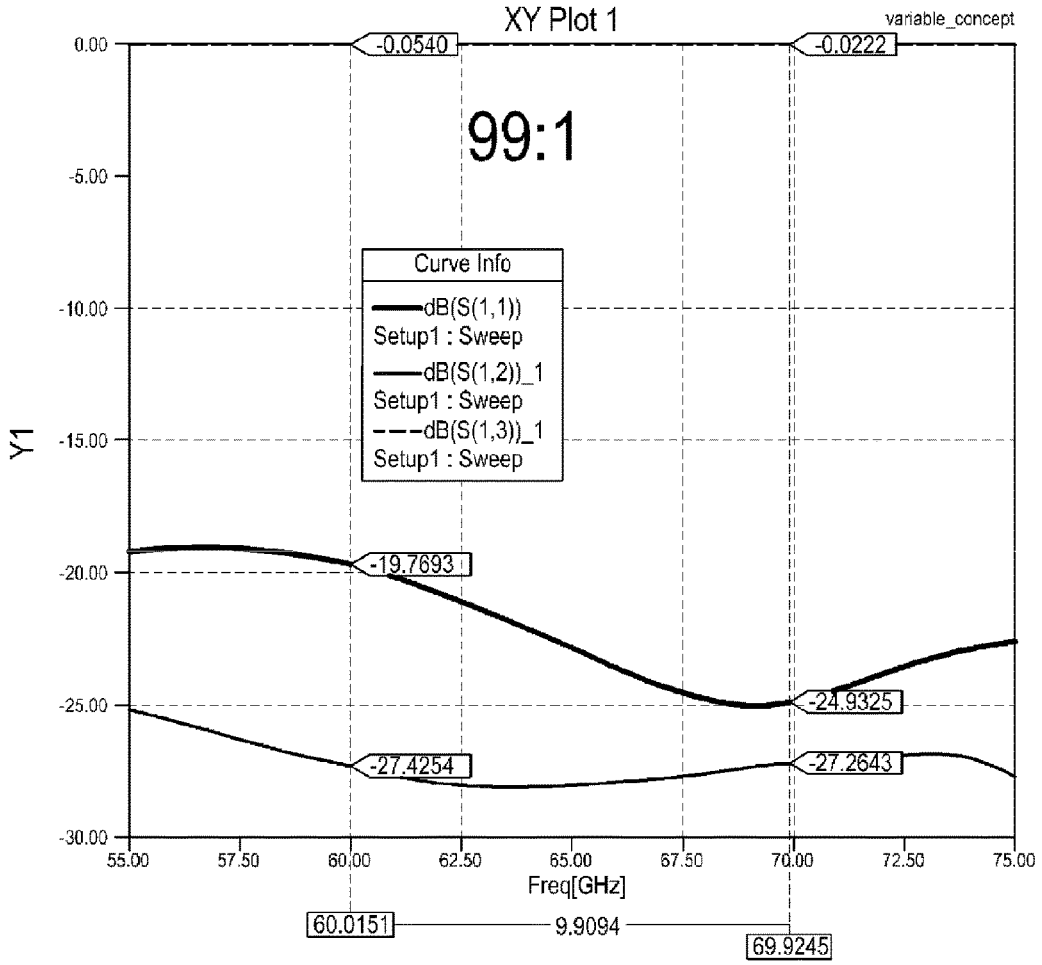

FIGS. 4A, 4B and 4C are graphs showing the electrical characteristics of the waveguide power divider in FIG. 1. FIG. 4A shows input/output characteristics of the corresponding waveguide power divider where the signal input by the input waveguide 110 is distributed to the first and second output waveguides 111, 112 at a ratio of 50:50(%) and then transmitted, respectively. FIG. 4B shows the characteristics where the signal input by the input waveguide 110 is distributed to the first and second output waveguides 111, 112 at a ratio of 75:25(%) and then transmitted, respectively. FIG. 4C shows the characteristics where the signal input by the input waveguide 110 is distributed to the first and second output waveguides 111, 112 at a ratio of 99:1(%) and then transmitted, respectively.

Figure 5A:
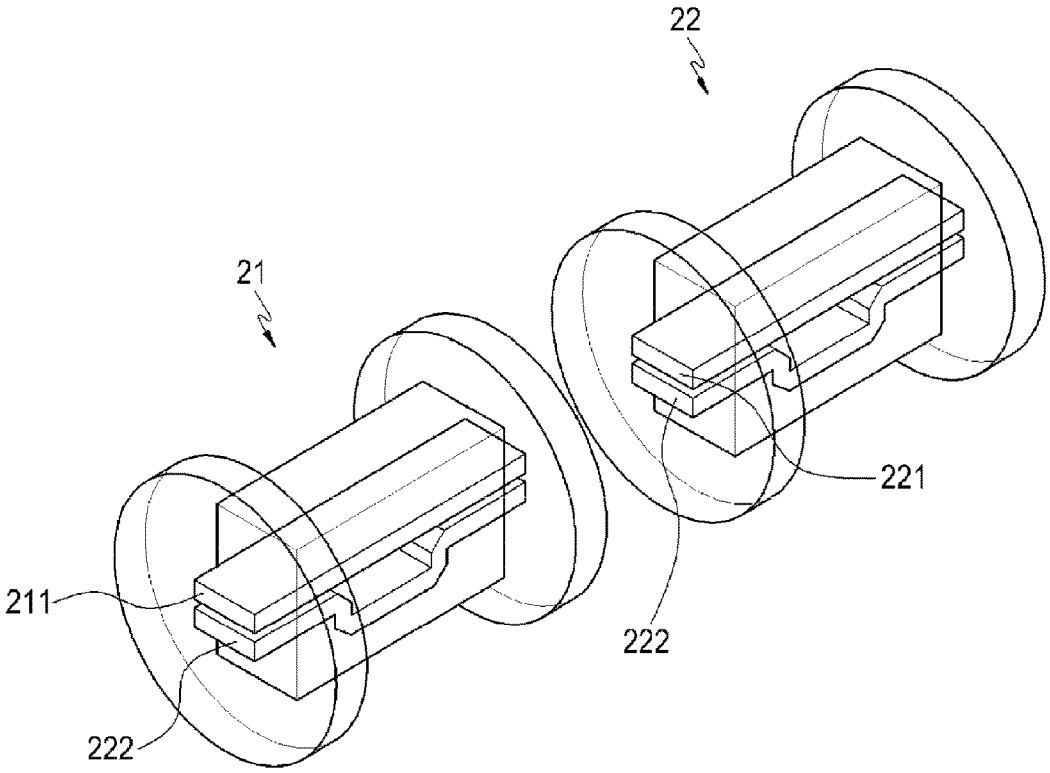
FIGS. 5A, 5B, 5C and 5D are partially transparent structural diagrams of the waveguide phase shifter in FIG. 1.
Figure 5B:
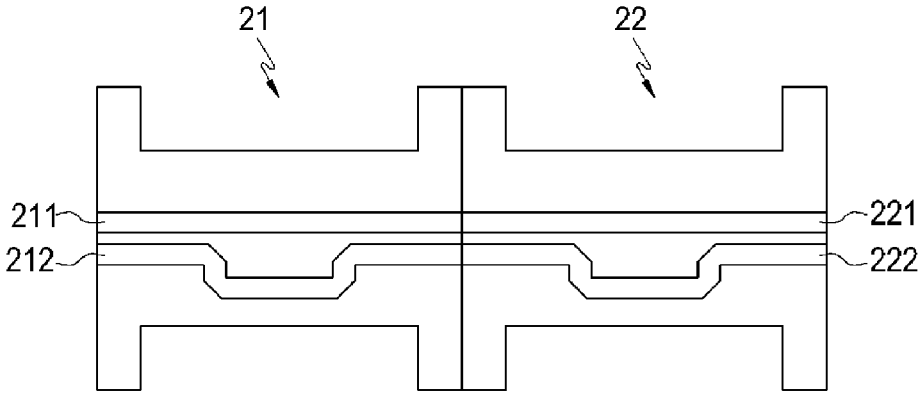
Figure 5C:
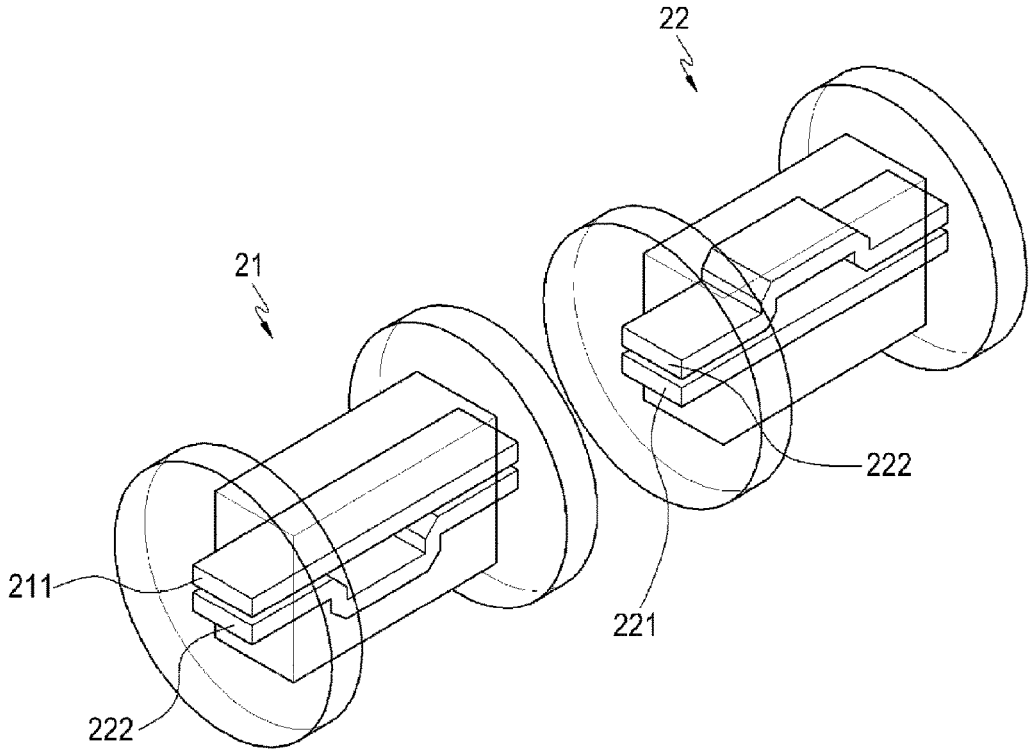
Figure 5D:
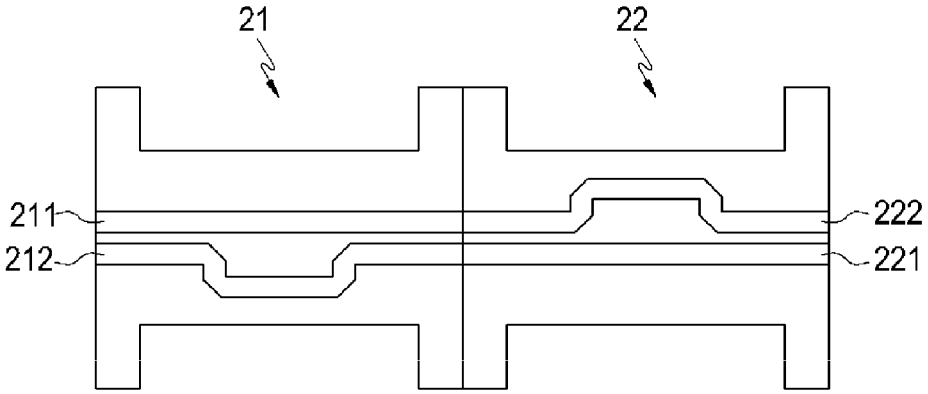
Figure 6A:
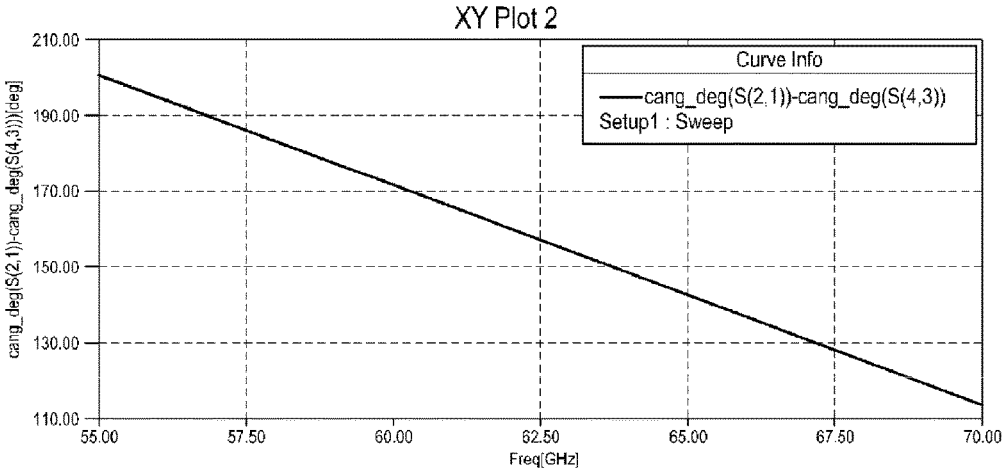
FIGS. 6A, 6B, 6C and 6D are graphs showing electrical characteristics of the waveguide phase shifter in FIG. 1.
Figure 6B:
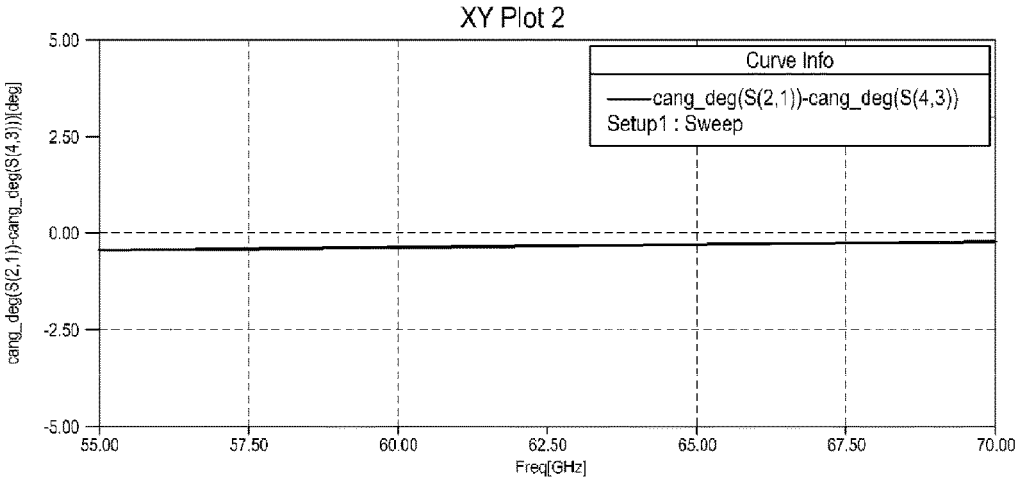
Figure 6C:
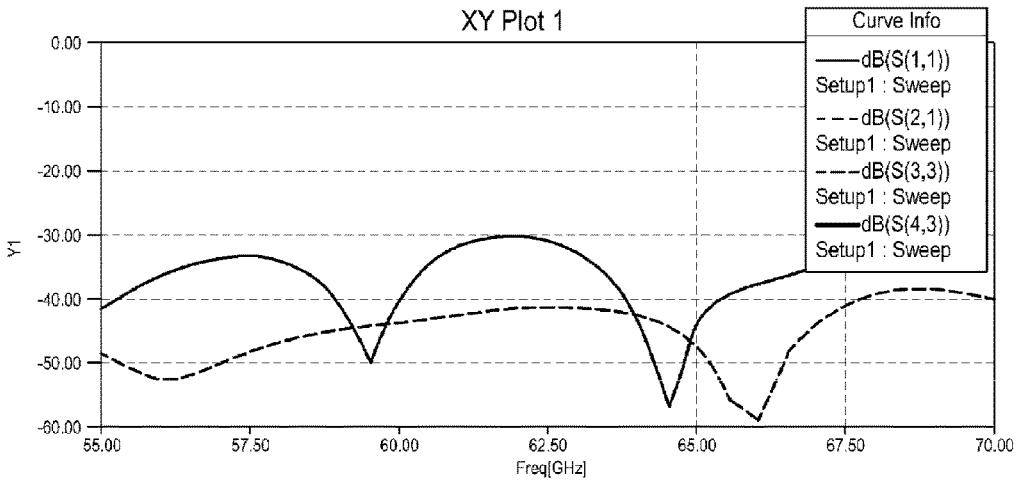
Figure 6D:
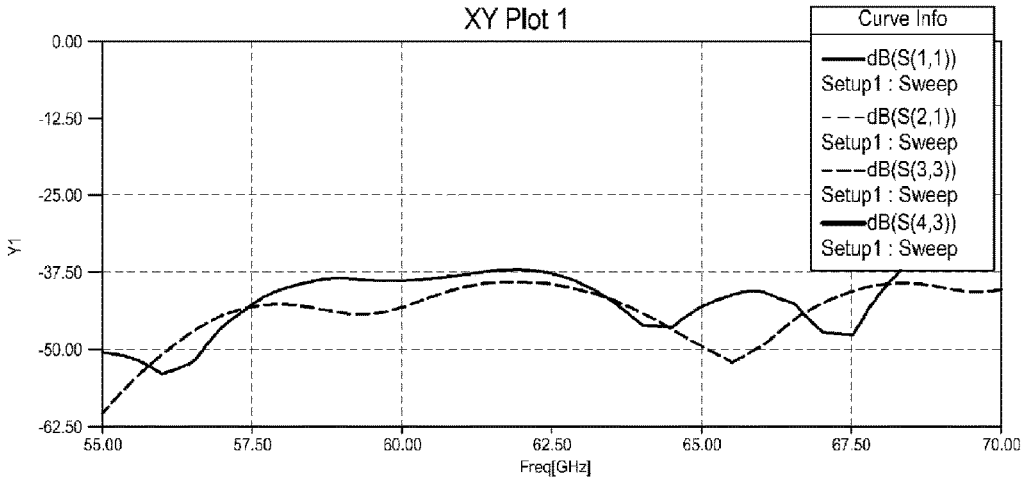

FIGS. 5A, 5B, 5C and 5D are structural diagrams of the waveguide phase shifter in FIG. 1. FIG. 5A is a transparent structural diagram showing that the waveguide phase shifter is in a first state. FIG. 5B is a side view of the structure of the waveguide phase shifter in FIG. 5A. FIG. 5C is a transparent structural diagram showing that the waveguide phase shifter is in a second state. FIG. 5D is a side view of the structure of the waveguide phase shifter in FIG. 5C.

Referring to FIGS. 5A to 5D, the waveguide phase shifter may be constituted by a first case 21 and a second case 22, partitively. The first case 21 has a first waveguide 211 designed in compliance with the characteristic of the relevant frequency to process, and a second waveguide 212 having a delaying waveguide path to provide a transmission signal with a preset phase difference (e.g., 90 degrees) with respect to the first waveguide 211. Likewise, the second case 22 also includes a third waveguide 221 designed in compliance with the characteristic of the relevant frequency to process, and a fourth waveguide 222 having a delaying waveguide path to provide a transmission signal with a preset phase difference (e.g., 90 degrees) with respect to the third waveguide 211.

At this time, the first case 21 and the second case 22 are configured to abut against each other, and the first, and second waveguides 211, 212 and the third, and fourth waveguides 221, 222 are designed so that the first waveguide 211 and the second waveguide 212 of the first case 21 respectively align accurately with the third waveguide 221 and the fourth waveguide 222 of the second case 22 at the input and output ends thereof.

Further, while maintaining the abutment between the first case 21 and the second case 22, at least one (for example, the second case) of them is installed rotatably about a rotation axis while being supported by an external support structure (not shown). In this case, the first waveguide 211 and the second waveguide 212 of the first case 21 are each formed symmetrically with respect to the rotation axis. Similarly, the third waveguide 221 and the fourth waveguide 222 of the second case 22 are each formed symmetrically with respect to the rotation axis. As a result, for example, when the second case 22 is rotationally inverted 180° from the initial state, the first-first waveguide 211 and the second waveguide 212 of the first case 21 are configured so as to be connected with the fourth waveguide 222 and the third waveguide 221 of the second case 22 at their input and output ends, as shown in FIGS. 5C and 5D.

With such a configuration, when the first and the cases 21, 22 assume state 1 (aka "initial state") shown in FIGS. 5A and 5B, the first-first waveguide 211 and the second waveguide 212 of the first case 21 are respectively connected with the third waveguide 221 and the fourth waveguide 222 of the second case 22 at their input/output ends, which causes the signals having passed through the first-first waveguide 211 and the second waveguide 212 (represented by a-oriented transmission signals) to be followed by the subsequent signals imparted with a 180-degree phase delay passing through the third waveguide 221 and the fourth waveguide 222 (represented by b-oriented transmission signals). In addition, when the first and the cases 21, 22 assume the state 2 shown in FIGS. 5C and 5D where the first-first waveguide 211 and the second waveguide 212 of the first case 21 are connected with the fourth waveguide 222 and the third waveguide 221 of the second case 22 at their input/output ends respectively, the signals having passed through the first-first waveguide 211 and the second waveguide 212 (the a-oriented transmission signals) are followed by the subsequent signals passing through the third waveguide 221 and the fourth waveguide 222 (the b-oriented transmission signals) without a phase delay. In addition to these cases, the first and second cases 21, 22 may be configured to be corotated 180 degrees° from the initial state shown in FIGS. 5A and 5B, when the a-oriented transmission signals are phase-delayed by 180 degrees. The states of the waveguide phase shifter as described above and shown in FIGS. 5A to 5D exhibit electrical characteristics as shown in FIGS. 6A to 6D.

The first or second case 21, 22 with the above-described configuration may have its first-first and second waveguides 211, 212 or the third and fourth waveguides 221, 222 so configured that they are connected with (e.g., precisely abut against), for example, the first and second output waveguides 111 and 112 of the waveguide power divider shown in FIG. 2 and other drawings. With such an arrangement of waveguides, the signals distributed and output by the waveguide power divider may have their phases varied passing through the waveguide phase shifter so that an appropriate phase difference is provided between the output signals.

The above description presents that the waveguide phase shifter is configured with, for example, 90 degrees of phase difference between the first-first and second waveguides 211 and 212 of the first case 21, or between the third and fourth waveguides 221 and 222, although their phase difference may be 45 degrees in another possible configuration. Further, in the above description, the first and second cases having mutually corresponding structures are used to implement the waveguide phase shifter, while other configurations are possible by adding up to the third, fourth, or later case that has a similarly corresponding structure.

Figure 7:
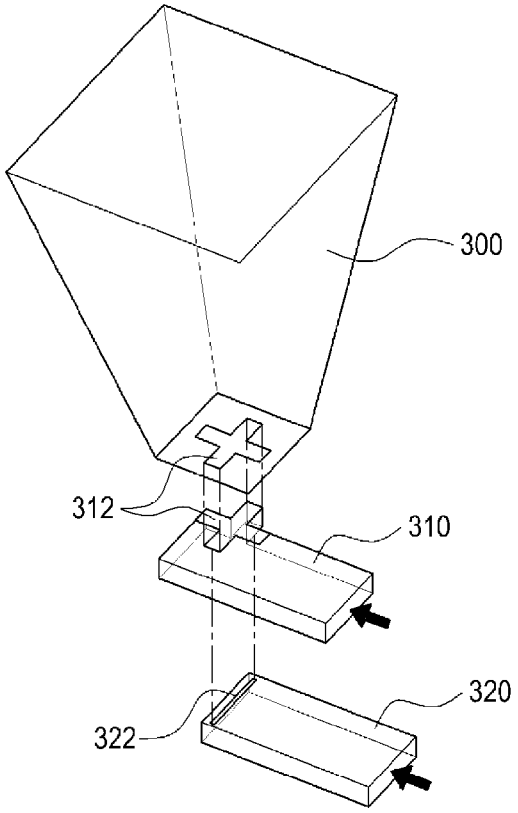
FIG. 7 is a transparent exploded perspective view of a radiating unit in FIG. 1.

FIG. 7 is a transparent exploded perspective view of a radiating unit in FIG. 1. The radiating unit in FIG. 7 is provided with signals respectively outputted via the two paths of the waveguide phase shifter (for example, via the b-oriented transmissions as illustrated by FIGS. 5B and 5D), so that it generates a polarization by combining the outputted signals. For this purpose, the radiating unit has first and second input waveguides 310 and 320 to which, for example, H polarization and V polarization are respectively input. The signal input to the second input waveguide 320 is transmitted through a slot 322 formed at an end of the second input waveguide 320 and delivered upward to a cavity coupling structure which is designed to assume an appropriate upper position. The signal is further delivered through a cross-shaped slot 312 of the coupling structure to a radiator 300. The other signal input to the first input waveguide 310 is provided to the radiator 300 via the cross-shaped slot 312 of the coupling structure connected with the first input waveguide 310.

Referring to the example of FIG. 7, the radiating unit has been described as having a horn antenna structure, but the radiating unit may employ various other antenna structures for generating dual polarization waves by combining transmission signals inputted respectively through the two-path waveguide structure.

Figure 9A:
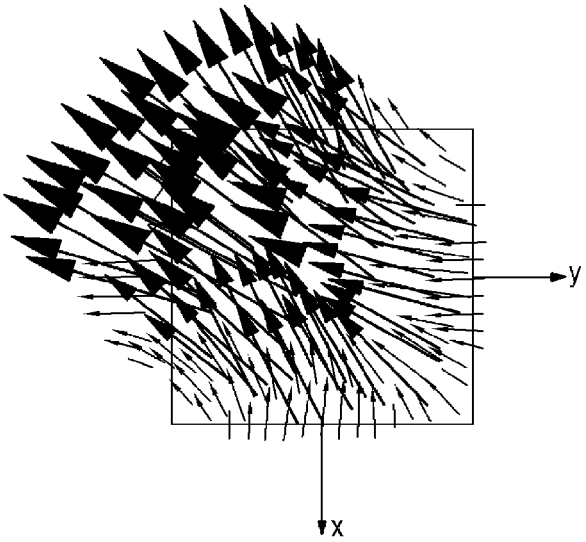
FIGS. 9A, 9B, 9C and 9D are graphical representations of radio field intensity showing example states of polarization variation of the polarized antenna in FIG. 1.
Figure 9B:
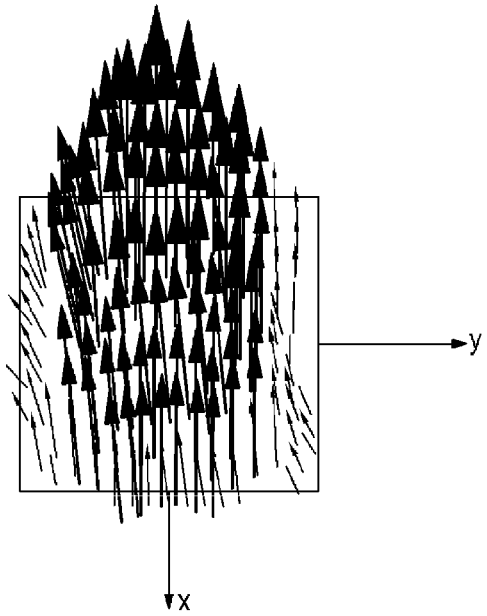
Figure 9C:
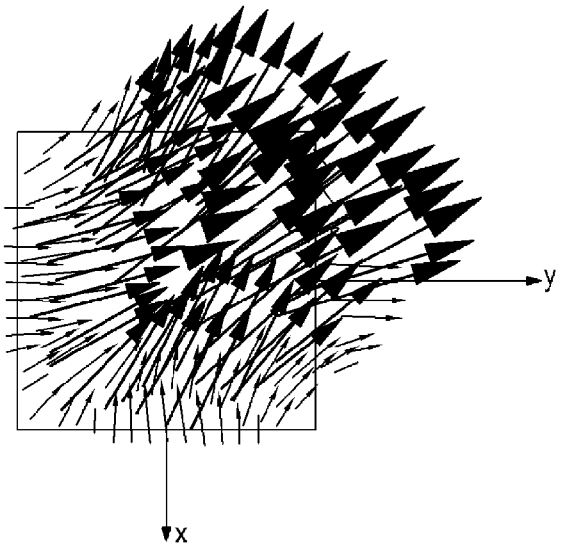
Figure 9D:
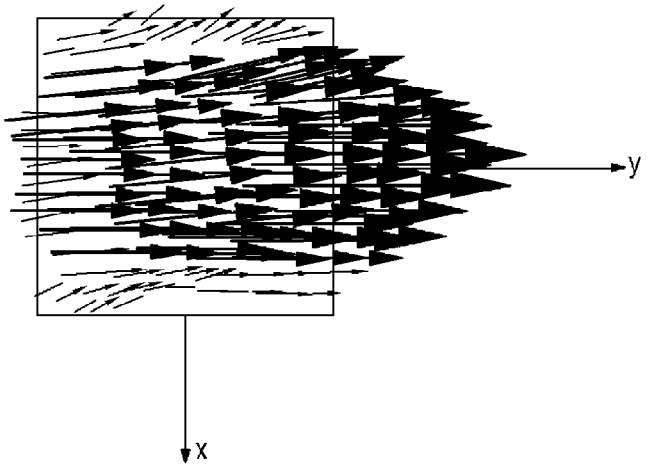

FIG. 8 is a table showing example polarization variations (for example, the first state, second state, third state, and fourth state) of the polarized antenna in FIG. 1, and FIGS. 9A, 9B, 9C and 9D are graphical representations of radio field intensity showing example polarization variations (for example, the first state, second state, third state, and fourth state) of the polarized antenna in FIG. 1. Referring to FIGS. 8 to 9D, for example, the first state (state1) represents when power distribution ratio of the first output waveguide of the waveguide power divider to the second output waveguide thereof is 50:50(%), and it exhibits the phase varying operation performed by the waveguide phase shifter with respect to the signals thus distributed so that the signals have phase difference of 180:0 (degrees) therebetween, where the power distribution ratio and the phase shifts lead to −45 degrees of polarization generated in the antenna as a whole.

In the second state (state 2), the power distribution ratio in the waveguide power divider between the first output waveguide and the second output waveguide of is 100:0(%). State 2 exhibits the phase varying operation performed by the waveguide phase shifter with respect to the signals thus distributed so that the signals have a phase difference of 0:0 (degrees), i.e., so that there is no phase difference therebetween, where the power distribution ratio and the phase shifts lead to V polarization generated in the antenna as a whole.

The third state (state 3) represents 50:50(%) of power distribution ratio in the waveguide power divider between the first output waveguide and the second output waveguide, and it exhibits the phase varying operation performed by the waveguide phase shifter with respect to the signals thus distributed so that there is no phase difference therebetween, where the power distribution ratio and the phase shifts lead to +45 degrees of polarization generated in the antenna.

The fourth state (state 4) represents 0:100(%) of power distribution ratio in the waveguide power divider between the first output waveguide and the second output waveguide, and it exhibits the phase varying operation performed by the waveguide phase shifter with respect to the signals thus distributed so that there is no phase difference therebetween, where the power distribution ratio and the phase shifts lead to H polarization generated in the antenna.

Figure 10A:
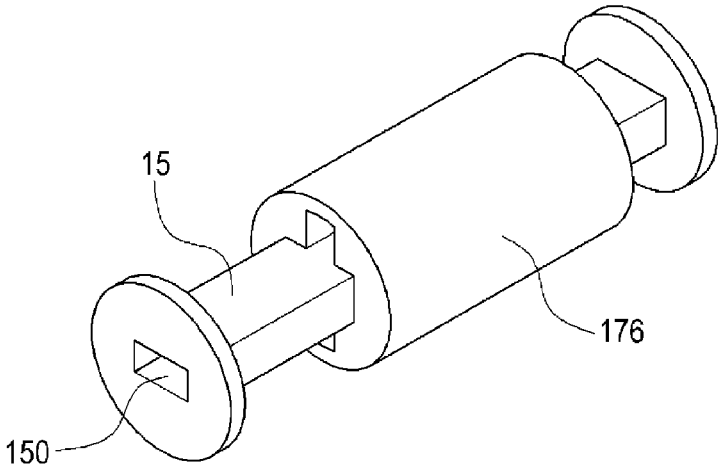
FIGS. 10A and 10B are perspective views of a waveguide power divider according to another embodiment of the present disclosure.
Figure 10B:
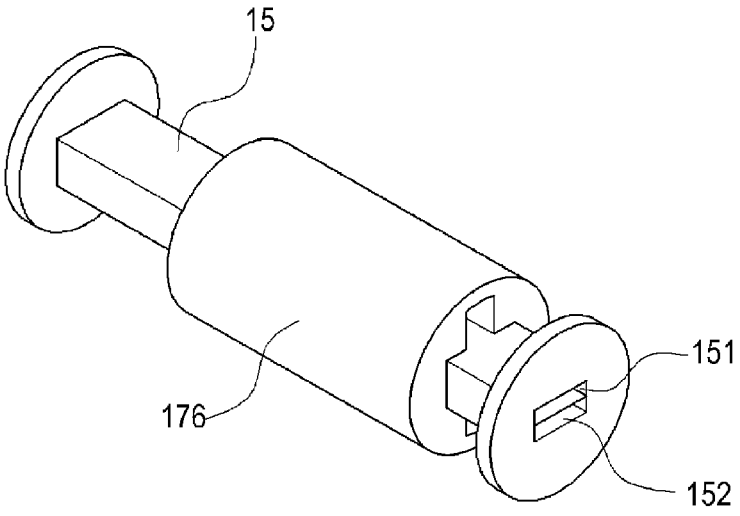
Figure 11A:
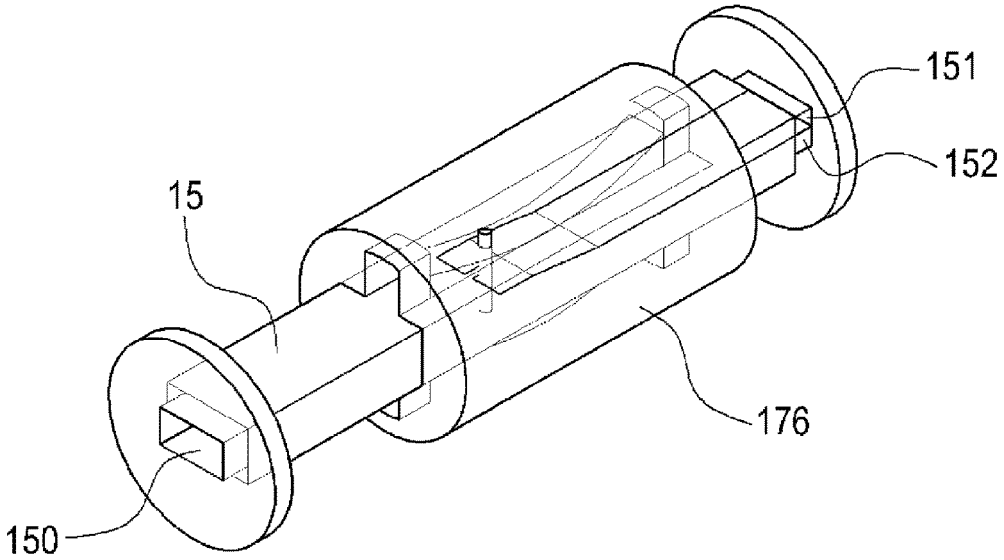
FIGS. 11A and 11B are partially transparent structural diagrams of the waveguide power divider in FIG. 10.
Figure 11B:
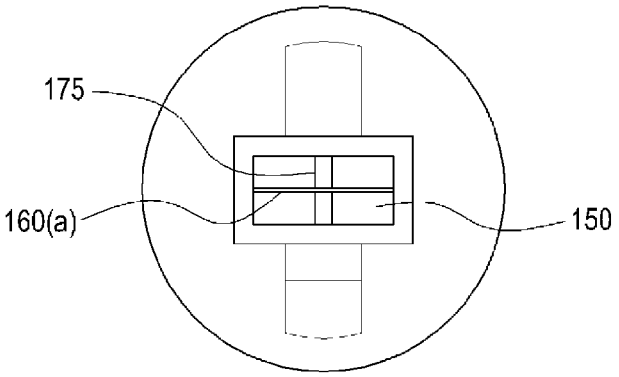
Figure 12:
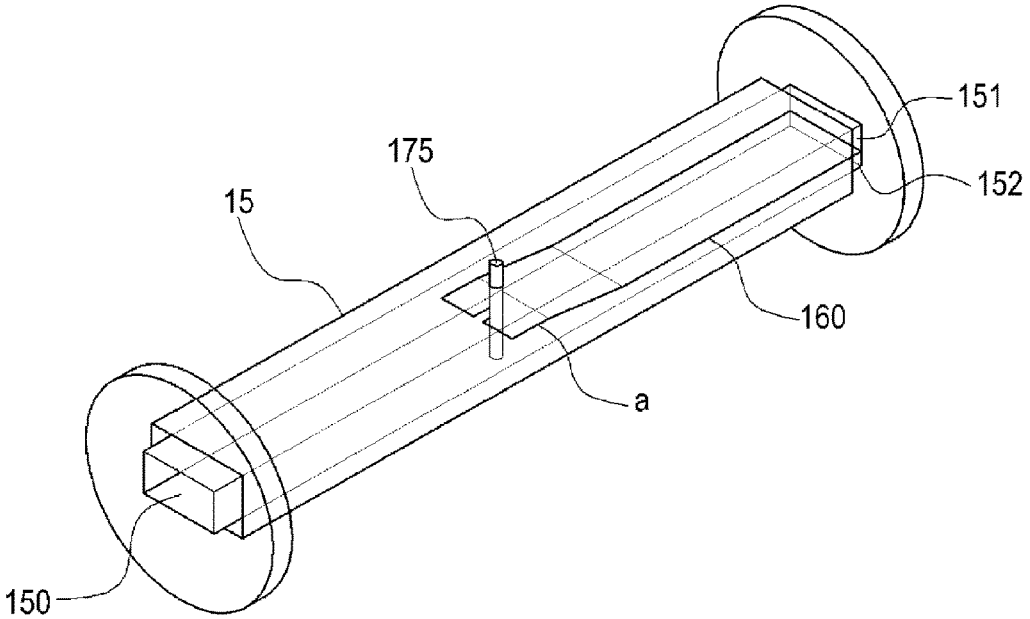
FIG. 12 is a transparent perspective view of a principal waveguide part in FIG. 10.
Figure 13A:
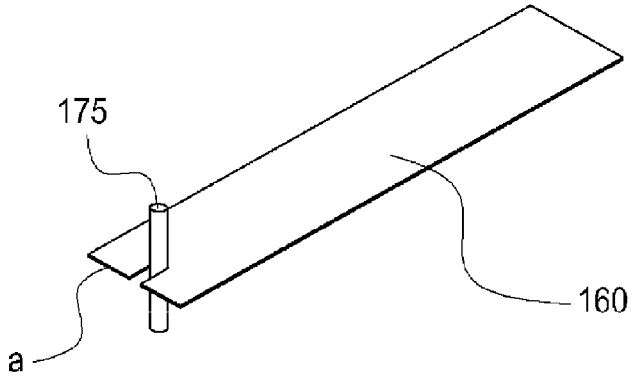
FIGS. 13A, 13B and 13C are structural diagrams of a power distribution adjusting plate and an adjusting pin in FIG. 10.
Figure 13B:
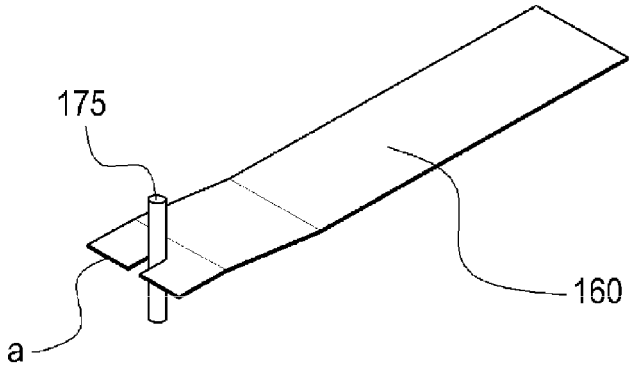
Figure 13C:
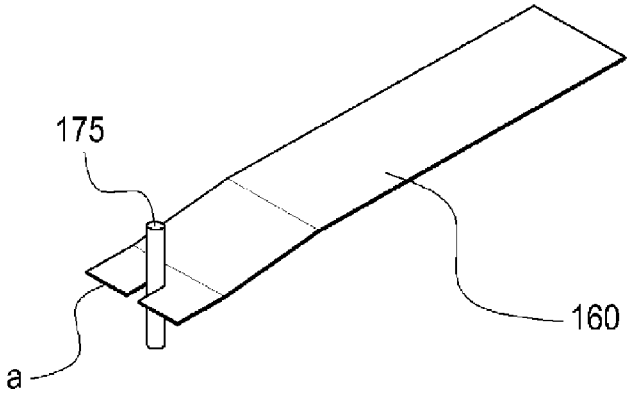
Figure 14A:
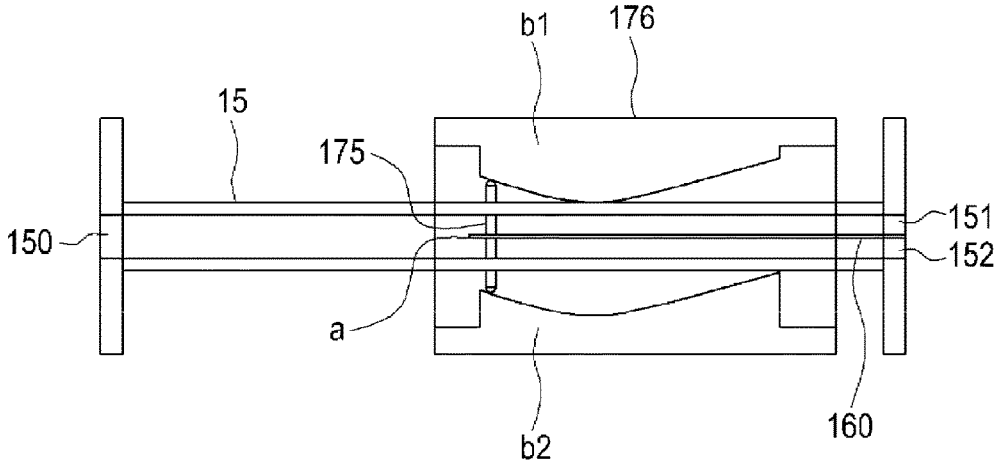
FIGS. 14A, 14B, 14C and 14D are transparent side views of the structure of the waveguide power divider in FIG. 10.
Figure 14B:
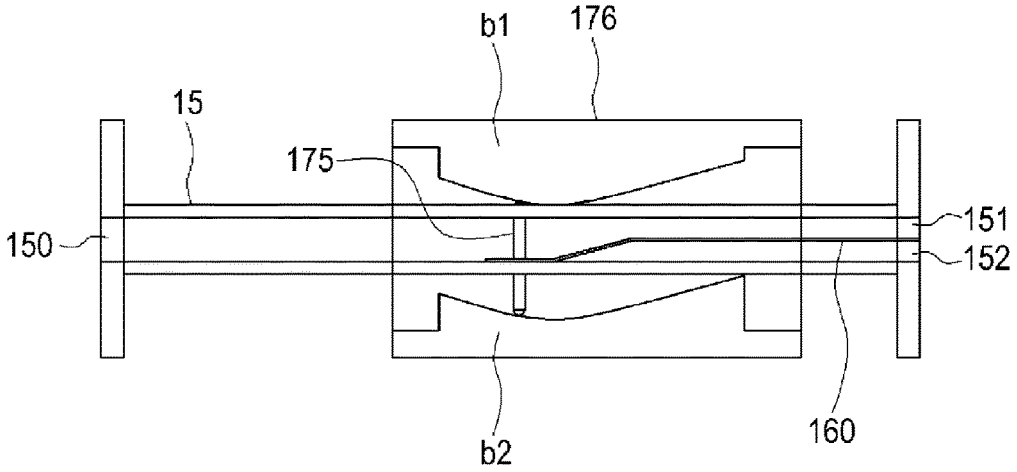
Figure 14C:
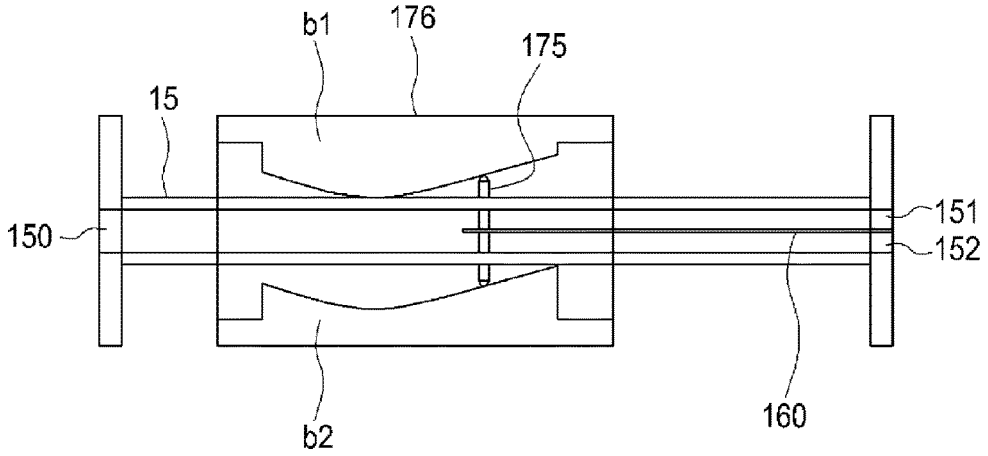
Figure 14D:
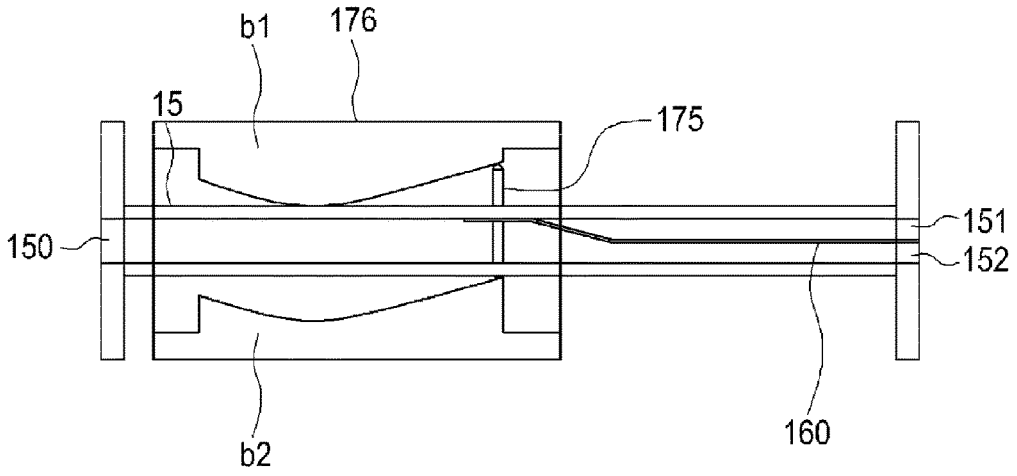

FIGS. 10A and 10B are perspective views of a waveguide power divider according to another embodiment of the present disclosure, wherein FIG. 10A shows a perspective view in one direction, FIG. 10B shows a perspective view in the other direction. FIGS. 11A and 11B are transparent structural diagrams of the waveguide power divider in FIG. 10, wherein FIG. 11A is a transparent perspective view, and FIG. 11B is a transparent front view. FIG. 12 is a transparent perspective view of a principal waveguide's part, i.e., a main cavity 175 in FIG. 10. FIGS. 13A, 13B and 13C are structural diagrams of a power distribution adjusting plate 160 and an adjusting pin 175 in FIG. 10, where FIG. 13A shows a state in which, for example, an input signal is transmitted after being divided into two separate signals at a ratio of 50:50(%), FIG. 13B into two separate signals at a ratio of 0:100(%), and FIG. 13C into two separate signals at a ratio of 100:0(%). FIGS. 14A, 14B, 14C and 14D are transparent side views of the structure of the waveguide power divider in FIG. 10, where FIG. 14A shows a slide operating device 176 at a sliding position where an input signal is transmitted after being divided into two separate signals at a ratio of 50:50(%), FIG. 14B shows the slide operating device 176 at a sliding position where an input signal is transmitted after being divided into two separate signals at a ratio of 100:0(%), FIG. 14C shows another example of the slide operating device 176 at a sliding position where an input signal is transmitted after being divided into two separate signals at a ratio of 50:50(%), and FIG. 14D into two separate signals at a ratio of 0:100(%).

Referring to FIGS. 10 to 14D, the waveguide power divider according to another embodiment of the present disclosure is similar to the structure shown in FIG. 2 and others, and it basically has a main case 15 made of metal for forming an input waveguide 150 designed in compliance with the characteristic of the relevant frequency to process, and first and second output waveguides 151, 152 that are structured to be connected to the input waveguide 150, and that are, without affecting the characteristic of the relevant frequency for processing, configured to merge with the input waveguide 150 and to be defined respectively by two halves of a cavity area in the main case, corresponding to the input waveguide 110.

Further, a power distribution adjusting plate 160 is provided in the form of a metal plate having an appropriate elasticity to form at least some of the first and second output waveguides 151, 152 partitioned by halving the cavity area corresponding to the input waveguide 150 in the main case 15. The power distribution adjusting plate 160 is installed so that most part thereof is fixed inside the cavity, but it has a portion connected to the input waveguide 150, i.e., a distal end portion 'a' corresponding to the point where the signal input at the input waveguide 150 is distributed to the first and second output waveguides 151, 152, which is not fixed but bendable so that it may move well enough to reach the upper or lower surface inside the cavity.

In addition, there are provided operating devices which are connected to the distal portion 'a' and which are capable of repositioning the distal portion 'a' in conjunction with an external operation. In the structure shown in FIG. 10 and others, the operating devices may basically include an adjustment pin 175 that has its middle point fixed, inside the cavity of the main case 15, to the distal portion 'a' of the power distribution adjusting plate 160. The adjustment pin 175 has opposite ends passing through holes formed at corresponding positions of the main case 15 and protruding externally thereof. The main case 15 is externally provided with an operating structure responsive to user manipulations for moving the externally protruding portions of the adjustment pin 175 up and down, resulting in movements of the distal portion 'a' of the power distribution adjusting plate 160 which is linked with the adjustment pin 175.

The operating structure may be a tubular sliding operation device 176 that is adapted to externally encase at least some of the main case 15 and to make sliding movements along the input waveguide and the first and second waveguides, and that is internally provided with inclined surfaces b1, b2 for abutting against the opposite protruding portions of the adjusting pin 175 to guide up and down movements of the adjusting pin 175 during the sliding movements.

With such a structure, as shown more clearly in FIGS. 14A to 14D, when the sliding operation device 176 is caused to slide back and forth along the waveguide, in conjunction therewith, the adjustment pin 175 moves up and down, and accordingly the distal end portion 'a' of the power distribution adjustment plate 160 in abutment with the adjustment pin 175 moves upward or downward. Such an operation results in the signal input to the input waveguide 150 being distributed to the first and second output waveguides 151, 152 with a variable distribution ratio before the distributed signals is outputted.

Such distal portion 'a' and its repositioning devices are similar to the formation of a valve structure, and they serve to open and close the first output waveguide 151 and the second output waveguide 152 in relative proportion to each other. At this time, the adjusting pin 175 is appropriately designed to have its size among other parameters determined with such consideration as not to adversely affect the signal processing performance of the corresponding distributor. Further, in this case, for example, on the outer surface of the main case 15, there may be prints of a suitable scale, a sliding operation guide sign and the like provided for user operation of the sliding operation device 176.

Figure 15:
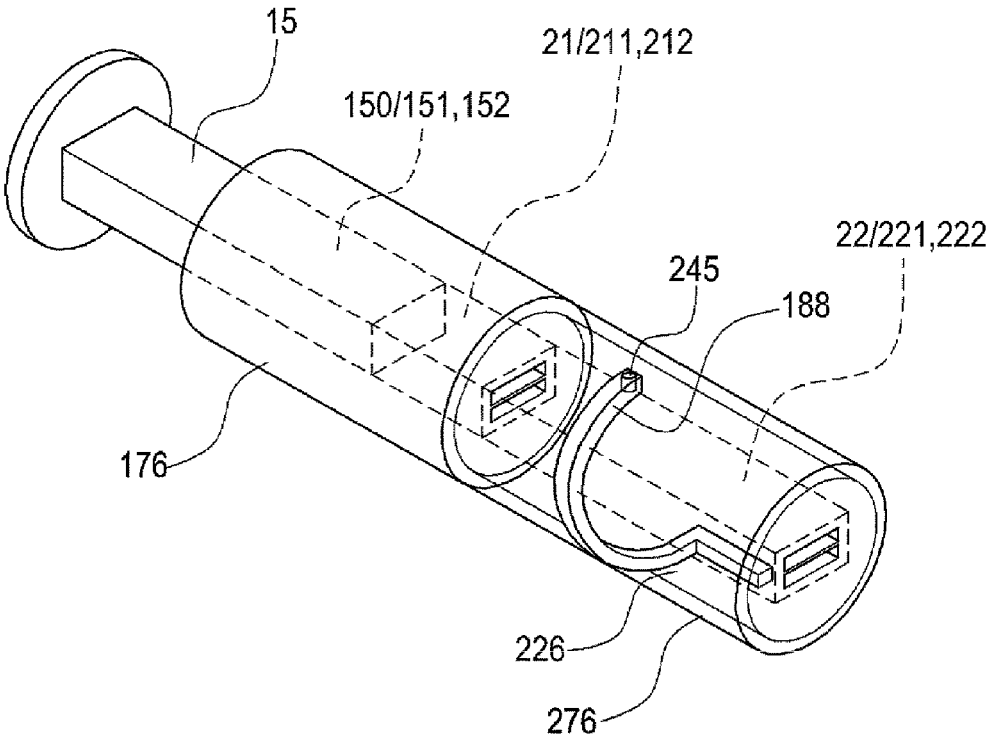
FIG. 15 is a partially transparent perspective view of a waveguide power divider and a waveguide phase shifter assembled according to yet another embodiment of the present disclosure.

FIG. 15 is a partially transparent perspective view of a waveguide power divider and a waveguide phase shifter assembled according to yet another embodiment of the present disclosure. Referring to FIG. 15, a structure according to still another embodiment of the present disclosure can be seen as a structural combination of the waveguide power divider shown in at least FIG. 10 and the waveguide phase shifter shown in at least FIG. 5A. In this case, for example, the main case 15 of the waveguide power divider and the first case 21 of the waveguide phase shifter may be integrally formed to each other (or formed to be fixed to each other). The second case 22 of the waveguide phase shifter is rotatably connected to the first case 21.

Formed integrally with the tubular sliding operation device 176 of the tube power divider, an external support structure 276 may be provided for rotatably supporting the second case 22, while maintaining the abutment of the first case 21 and the second case 22 of the waveguide phase shifter against each other. This arrangement enables the external support structure 276 to move in unison with the sliding operation device 176 when it makes sliding movements. Here, the second case 22 has a cylindrical shell 226 with a protrusion 245 formed at an appropriate outer position thereof. In addition, the external support structure 276 may be formed with, for example, a helical guide groove 188 adapted to receive the protrusion 245 of the second case 22 and to serve as a guide utilizing the sliding movements for properly rotating the protrusion 245 and thus the second case 22 at the same time. In order to appropriately vary the polarization at the polarization antenna to which the corresponding waveguide power divider and waveguide phase shifter is applied, the power distribution operation of the waveguide power divider needs to match the phase varying operation the waveguide phase shifter, for which the protrusion 245 formed on the second case 22 and the guide groove 188 formed in the external support structure 276 are designed to have appropriate positions and shapes.

As described above, one can realize the configurations and operations of the waveguide power divider, the waveguide phase shifter and the polarization antenna using the waveguide power divider and waveguide phase shifter according to some embodiments of the present disclosure. Although specific examples have been described in the description, various modifications can be made without departing from the scope of the present disclosure. For example, in the above description, the operating devices have been described through some embodiments for performing the power distribution operation of the waveguide power divider. Besides, various valve structures may be employed to move the end of the power distribution adjusting plate of the waveguide power divider. Likewise, operating devices for manipulating the waveguide phase shifter may have various other structures than the above-described structures.

Therefore, various other modifications and alterations of the present disclosure may be made. Accordingly, one of ordinary skill would understand that the scope of the present disclosure is not to be limited by the illustrative embodiments as above but by the claims and equivalents thereof.

The invention claimed is:

1. A polarized antenna, comprising:

a waveguide power divider configured to have an input waveguide for receiving a transmission signal, and first and second output waveguides for distributing and outputting the transmission signal;

a waveguide phase shifter configured to receive two output signals outputted respectively from the first and second output waveguides of the waveguide power divider, to variably change a phase difference between the two input signals, and to output respective changed signals; and a radiating unit configured to receive the respective changed signals from the waveguide phase shifter, and to combine and radiate the respective changed signals as a radio signal, wherein the waveguide power divider comprises:

a main case made of metal configured to form an input waveguide designed in compliance with a characteristic of a relevant frequency to process, and to form first and second waveguides that are, without affecting the characteristic of the relevant frequency to process, configured to merge with the input waveguide and to be defined respectively by two halves of a cavity area in the main case, the cavity area corresponding to the input waveguide;

a power distribution adjusting plate configured to be formed by at least some of the first and second output waveguides partitioned by halving the cavity area corresponding to the input waveguide in the main case, and to have a distal end portion that corresponds to a point where a signal input at the input waveguide is distributed to the first and second output waveguides and that is movable to reach upper or lower surface in an internal cavity of the main case; and an operating device configured to be connected to the distal end portion, and to reposition the distal end portion in conjunction with an external manipulation.

2. The polarized antenna of claim 1, wherein the operating device comprises:

a rotation knob installed on an outer side of the main case; and an adjustment pin configured to be rotated in conjunction with the rotation knob in the internal cavity of the main case, and to be provided with a threaded structure generally externally of the adjustment pin, and wherein the distal end portion of the power distribution adjustment plate is configured to be provided with a hole or grooves sized to engage with the threaded structure of the adjustment pin and to have a predetermined room for the adjustment pin to slightly move in fore and aft direction.

3. The polarized antenna of claim 2, wherein the operating device comprises:

an adjustment pin configured to have a middle point fixed, in the internal cavity of the main case, to the distal end portion of the power distribution adjusting plate, and have opposite ends passing through holes formed at corresponding positions of the main case and protruding externally of the main case; and an operating structure configured to be disposed externally of the main case to upwardly and downwardly move the adjustment pin by portions protruding externally.

4. The polarized antenna of claim 3, wherein the operating device comprises:

a tubular sliding operation device configured to externally encase at least some of the main case and to make sliding movements along the input waveguide and the first and second waveguides, and to internally have inclined surfaces for abutting against the adjusting pin at the portions protruding externally, to guide up and down movements of the adjusting pin during the sliding movements.

5. A polarized antenna, comprising:

a waveguide power divider configured to have an input waveguide for receiving a transmission signal, and first and second output waveguides for distributing and outputting the transmission signal;

a waveguide phase shifter configured to receive two output signals outputted respectively from the first and second output waveguides of the waveguide power divider, to variably change a phase difference between the two input signals, and to output respective changed signals; and a radiating unit configured to receive the respective changed signals from the waveguide phase shifter, and to combine and radiate the respective changed signals as a radio signal, wherein the waveguide phase shifter comprises:

a first case configured to have a first waveguide designed in compliance with a characteristic of a relevant frequency to process, and a second waveguide having a delaying waveguide path to provide a transmission signal with a preset phase difference with respect to the first waveguide; and a second case configured to have a third waveguide designed in compliance with the characteristic of the relevant frequency to process, and a fourth waveguide having a delaying waveguide path to provide a transmission signal with a preset phase difference with respect to the third waveguide; and wherein the first case and the second case are configured and provided so that the first waveguide and second waveguide of the first case respectively have input and output ends aligned with input and output ends of the third waveguide and the fourth waveguide of the second case, the first case and the second case are configured to be in abutment while at least one of the first case and the second case is rotatable and is supported by an external support structure, and the first waveguide and the second waveguide of the first case are each formed symmetrically with respect to an axis of rotation of the at least one of the first case and the second case, and the third waveguide and the fourth waveguide of the second case are each formed symmetrically with respect to the axis of rotation.

6. The polarized antenna of claim 5, wherein the preset phase difference is 90 degrees.

7. A polarized antenna, comprising:

a waveguide power divider configured to have an input waveguide for receiving a transmission signal, and first and second output waveguides for distributing and outputting the transmission signal;

a waveguide phase shifter configured to receive two output signals outputted respectively from the first and second output waveguides of the waveguide power divider, to variably change a phase difference between the two input signals, and to output respective changed signals; and a radiating unit configured to receive the respective changed signals from the waveguide phase shifter, and to combine and radiate the respective changed signals as a radio signal, wherein the radiating unit has a structure configured to combine transmission signals along two paths, which are inputted through a waveguide structure so as to generate a linearly polarized wave.

8. A waveguide power divider, comprising:

a main case made of metal configured to form an input waveguide designed in compliance with a characteristic of a relevant frequency to process, and to form first and second output waveguides that are structured to be connected to the input waveguide, and that are, without affecting the characteristic of the relevant frequency to process, configured to merge with the input waveguide and to be defined respectively by two halves of a cavity area in the main case, the cavity area corresponding to the input waveguide;

a power distribution adjusting plate configured to be formed by at least some of the first and second output waveguides partitioned by halving the cavity area corresponding to the input waveguide in the main case, and to have a distal end portion that corresponds to a point where a signal input at the input waveguide is distributed to the first and second output waveguides and that is movable to reach upper or lower surface in an internal cavity of the main case; and an operating device configured to be connected to the distal end portion, and to reposition the distal end portion in conjunction with an external manipulation.

9. A waveguide phase shifter, comprising:

a first case configured to have a first waveguide designed in compliance with a characteristic of a relevant frequency to process, and a second waveguide having a delaying waveguide path to provide a transmission signal with a preset phase difference with respect to the first waveguide; and a second case configured to have a third waveguide designed in compliance with the characteristic of the relevant frequency to process, and a fourth waveguide having a delaying waveguide path to provide a transmission signal with a preset phase difference with respect to the third waveguide; and wherein the first case and the second case are configured and provided so that the first waveguide and second waveguide of the first case respectively have input and output ends aligned with input and output ends of the third waveguide and the fourth waveguide of the second case, the first case and the second case are configured to be in abutment while at least one of the first case and the second case is rotatable and is supported by an external support structure, and the first waveguide and the second waveguide of the first case are each formed symmetrically with respect to an axis of rotation of the at least one of the first case and the second case, and the third waveguide and the fourth waveguide of the second case are each formed symmetrically with respect to the axis of rotation.

* * * * *